US005960885A

United States Patent [19]

Edwards et al.

[11] Patent Number: 5,960,885

[45] Date of Patent: Oct. 5, 1999

[54] DUAL BORE RISER

[75] Inventors: Jeffrey Charles Edwards, Dyce; Michael Graham Morgan, Banff, both of United Kingdom

[73] Assignee: Expro North Sea Limited, United Kingdom

[21] Appl. No.: 08/930,233

[22] PCT Filed: Feb. 27, 1996

[86] PCT No.: PCT/GB96/00435

§ 371 Date: Dec. 5, 1997

§ 102(e) Date: Dec. 5, 1997

[87] PCT Pub. No.: WO96/28634

PCT Pub. Date: Sep. 19, 1996

[30] Foreign Application Priority Data

Mar. 14, 1995 [GB] United Kingdom ..... 9505129

[51] Int. Cl.[6] ..... E21B 33/038; E21B 17/01

[52] U.S. Cl. ..... 166/345; 166/350; 166/367; 166/380; 166/77.2

[58] Field of Search ..... 166/367, 380, 166/350, 340, 77.2, 72, 359, 208, 345; 405/195.1

[56] References Cited

U.S. PATENT DOCUMENTS 4,059,148 11/1977 Blomsma ..... 166/208 X 5,161,620 11/1992 Ritter, Jr. ..... 166/359

*Primary Examiner*—Roger Schoeppel

*Attorney, Agent, or Firm*—Gifford, Krass, Groh, Sprinkle, Anderson & Citkowski, P.C.

[57] ABSTRACT

A dual bore riser system is described which includes a conventional monobore riser (12) for production access and an independent coil tubing (14) disposed in parallel with the monobore riser (12) for providing annular access. The monobore riser includes discrete A joints of tubing, casing or drill pipe and the coil tubing riser may be any suitable size but is normally between 2⅜" and 2⅞" outside diameter. The standard monobore riser (12) and coil tubing riser (14) is fed from a coiled tubing reel (78), which is conventional, via a sheave (80) and straightening rollers into the well with the tubing riser. The coiled tubing is clamped to the tubing riser by clamps (16) at intervals along its length corresponding to a joint every 30 ft. The upper end of the landing spool adaptor (28) receives the tubing (14) and also contains a termination for the coiled tubing which is typically a swage device (32). The 5"×2" landing spool adaptor (28) and landing spool (29) has an 18" outside diameter to fit into the BOP stack (42), and the landing spool (29) has a smooth outside surface for co-operating with the interior of the annular BOP.

12 Claims, 8 Drawing Sheets

DUAL BORE RISER

The present invention relates to a dual bore riser for use in sub-sea production or water or gas injection systems.

Most conventional sub-sea production systems require a dual bore riser to provide access to a larger production bore and an annulus bore which is smaller. A conventional dual bore riser system consists of a large number of parts which require to be assembled during run-in. At the present time the cost of a conventional dual bore riser costs approximately £1,000 per foot and requires significant storage space which is normally limited on off-shore vessels. When such a conventional riser is run, it requires a considerable amount of specialised equipment for handling and make-up such as spiders etc. This has an impact in terms of both purchase cost and increased running times.

FIG. 1 shows an exploded view of the principal parts of a conventional dual parallel bore riser system. It will be seen that approximately ten parts shown, the surface tree, a riser handling spider, a surface tree adaptor joint, a riser tensioning joint, a standard riser joint and a riser handling test tool, a dual parallel bore riser joint adaptor which is approximately 40 ft. long, an orientation joint, it will be seen from this drawing that the entire structure is relatively complex and includes the assembly of a considerable number of prefabricated components which, as outlined above, require significant storage space which is normally limited on off-shore vessels.

An object of the present invention is to obviate or mitigate at least one of the aforementioned disadvantages.

A further object of the present invention is to provide an improved dual bore riser which is relatively less expensive to purchase and to run and which requires significantly less storage space than a conventional riser system.

A further object of the present invention is to obviate the requirement for specialised handling equipment and make-up of the dual bore riser.

This is achieved by providing a dual bore riser system which comprises a conventional monobore riser for production access and a independent coil tubing disposed in parallel with the monobore riser for providing access into the annular space between production coiling and production tubing. The monobore riser comprises discrete joints of tubing, casing or drill pipe and the coil tubing riser which may be any size of coiled tubing but normally between 2⅜" and 2⅞" outside diameter.

During deployment of the tubing hanger the standard monobore riser and coil tubing riser interface with the tubing hanger running tool via a landing spool or adaptor adaptor. The coiled tubing is deployed from a storage reel, via a roller sheave and straightening rollers into the well with the tubing riser. The coiled tubing is clamped to the tubing riser at intervals along its length corresponding to a joint every 30 ft.

The upper end of the landing spool or adaptor receives the tubing and also contains a termination for the coiled tubing which is typically a swage device. The dual parallel bore landing spool adaptor and landing spool has an outside diameter to fit into the 18¾" BOP stack and the landing spool has a smooth outside surface for co-operating with the interior of the annular BOP.

The monobore and coiled tubing risers may be coupled to one of; a conventional stress joint and riser disconnect package to a sub-sea Christmas tree, a dual bore proprietary tubing hanger or a dual bore test tree which fits beneath the blind/shear rams in the BOP stack in the same manner as disclosed in corresponding International Patent Application WO93/03255.

According to one aspect of the present invention, there is provided a method of running intervention equipment into a well during or after completion, said method comprising:

providing well equipment for running into a well, coupling sequential sections of tubing riser to the well equipment, providing a coiled tubing riser of smaller diameter than the tubing riser, coupling the coiled tubing riser to said tool and feeding the coiled tubing riser with the tubing riser to create a structure such that the tubing riser is adjacent and parallel to the coiled tubing, coupling the coiled tubing riser to the tubing riser at a plurality of spaced locations along the length of the riser to create a dual bore riser, and raising or lowering the dual bore riser with the well equipment is required for well operations.

Preferably, the method includes restraining the coiled tubing to the tubing riser at each joint along the length of the tubing riser.

Preferably, the dual bore or 5"×2" completion sub-sea tree has a main bore and a parallel annulus bore, the main bore having at least one operable valve and the annulus bore having at least one operable valve.

Conveniently, wireline access is possible using the improved dual bore riser by cutting the coiled tubing at the surface and terminating the cut tubing to a frame and valve assembly which is clamped to a conventional surface tree. The method is such that the frame allows the coiled tubing to be pretensioned, therefore avoiding the requirement for an accurate termination of the coiled tubing and compensating for any changes in overall length between the two riser strings. When no wireline operation is required, the coiled tubing may be left on the reel thereby providing annulus communication through the tubing on the reel via a conventional slip ring assembly.

According to another aspect of the present invention there is provided an improved dual bore riser for coupling to intervention well equipment prior to the installation of a sub-sea production tree, said improved dual bore riser comprising:

a first tubular riser element of a first bore diameter, a second coiled tubing annulus riser element, said first and second riser elements being adapted to be connected to a well intervention tool, said first and second riser elements being coupled together at a plurality of spaced locations along the length of the riser.

Preferably, the second coiled tubing riser is coupled to the first tubing riser at every riser joint along its length.

Preferably also, the well tool run is a 5"×2" completion sub-sea test tree. Alternatively, the well tool may be any other suitable well intervention equipment tool.

Conveniently, the coiled tubing is coupled to a landing spool disposed between the riser and the completion test tree. The coiled tubing is coupled to the landing spool via swage and quick connector system and the tubing riser is coupled to the landing spool via a landing spool adaptor.

A method of forming a dual bore riser for running well intervention equipment, said method comprising the steps of:

providing a plurality of first tubular riser sections of a first diameter providing a second coiled tubing annulus riser stored on a reel;

coupling said first tubular riser sections together to form a first tubular riser, unreeling said coil tubing annulus riser from the reel, and coupling the unreeled tubing riser to the first tubular riser at spaced locations along the length of the assembled first tubular riser to create a dual bore riser.

These and other aspects of the present invention will become apparent from the following description when taken in combination with the accompanying drawings in which.

Figure 3B:
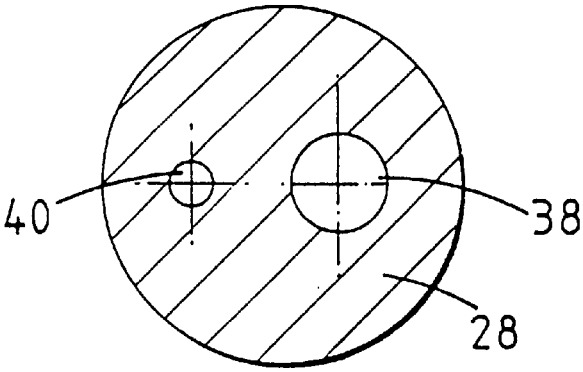
Figure 3A:
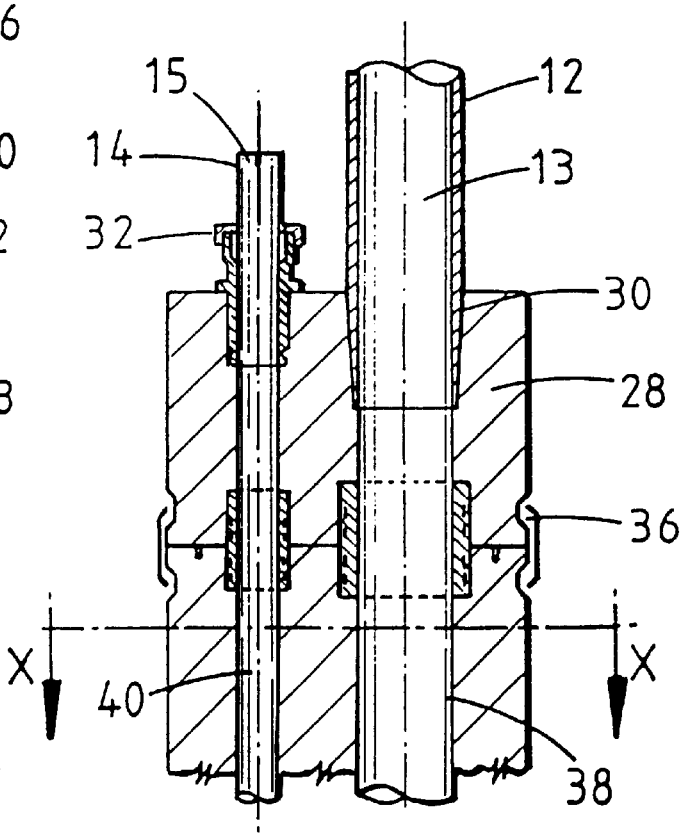
Figure 4:
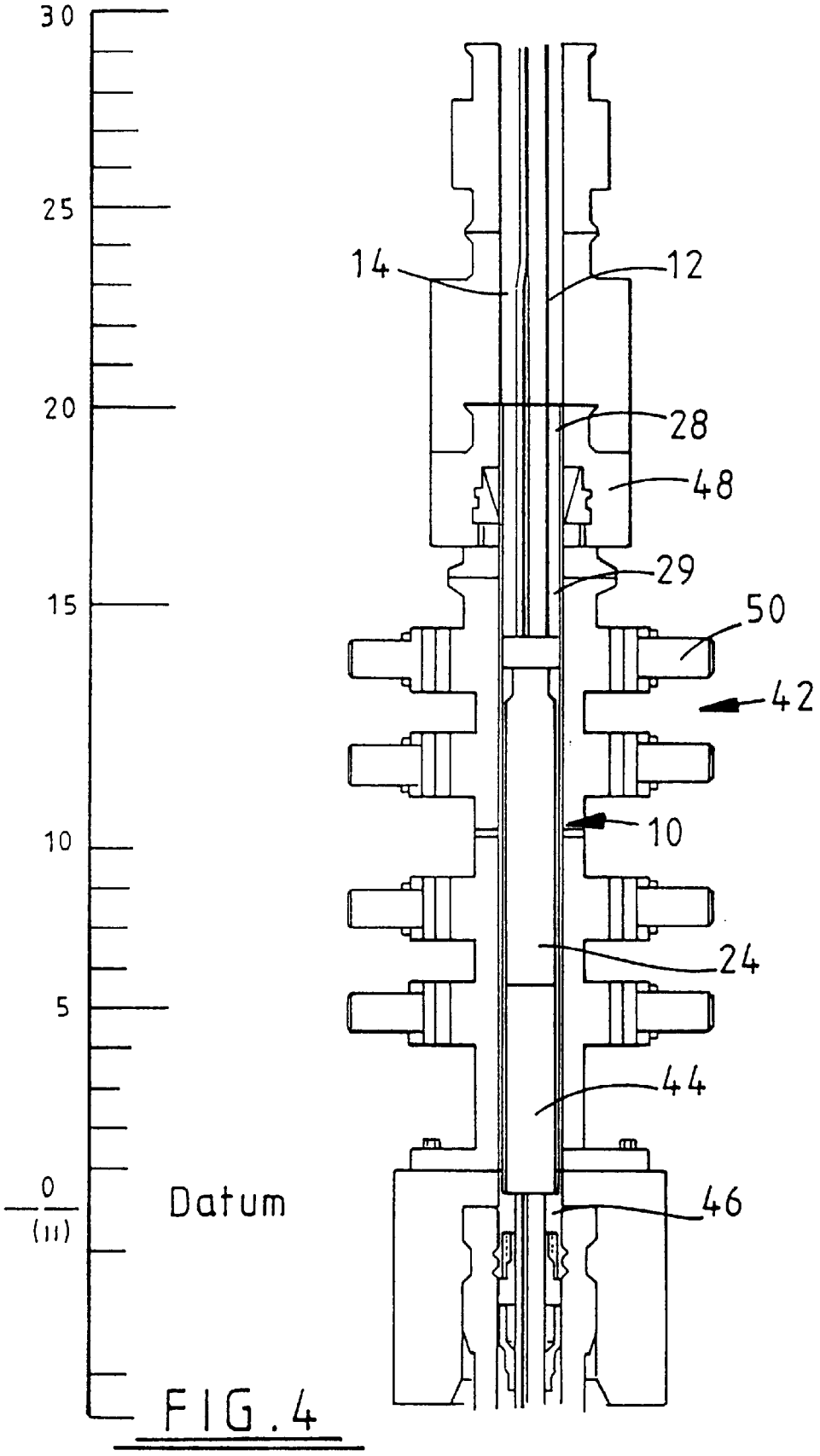
Figure 5:
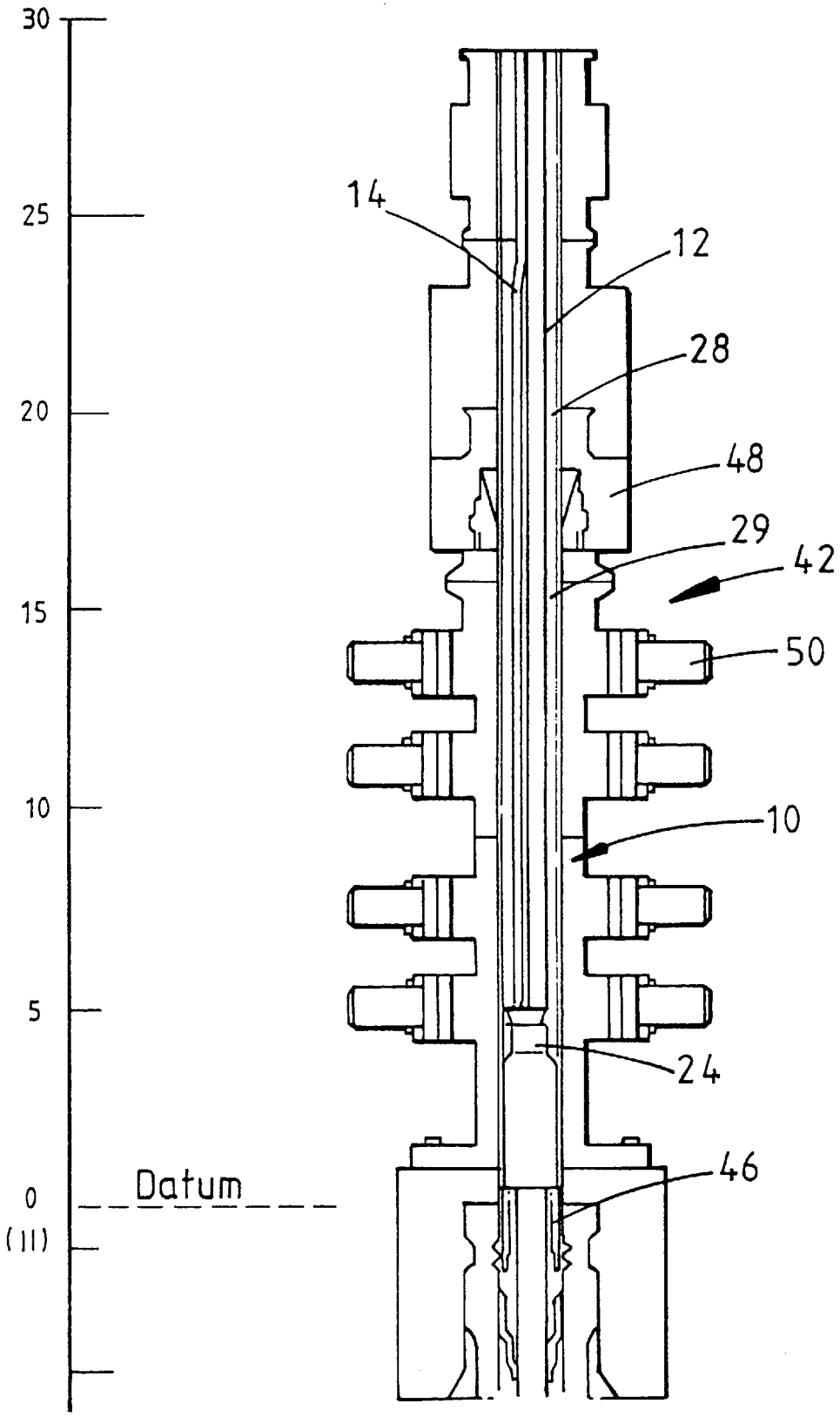
Figures 6, 7:
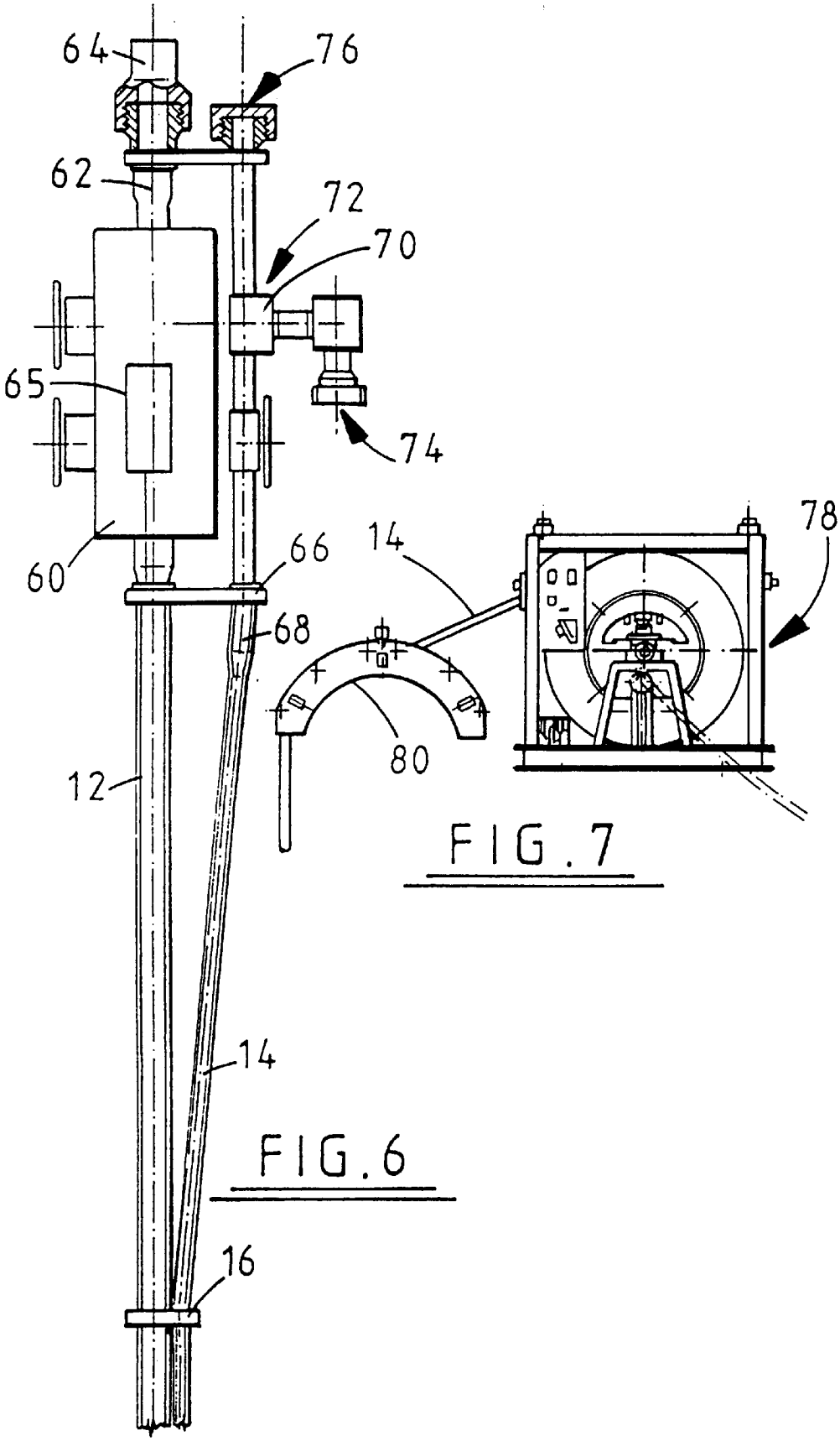
Figure 8:
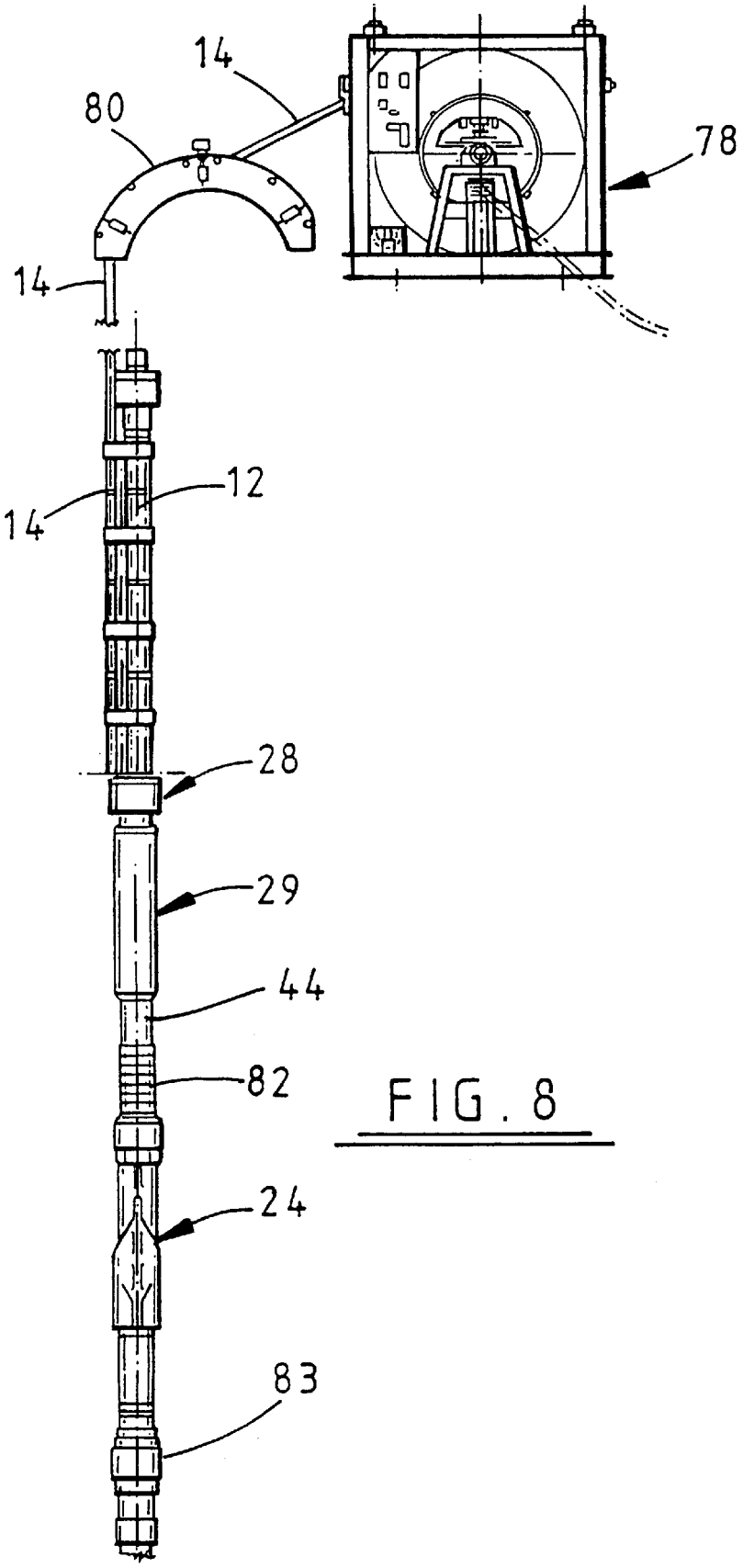
Figure 9:
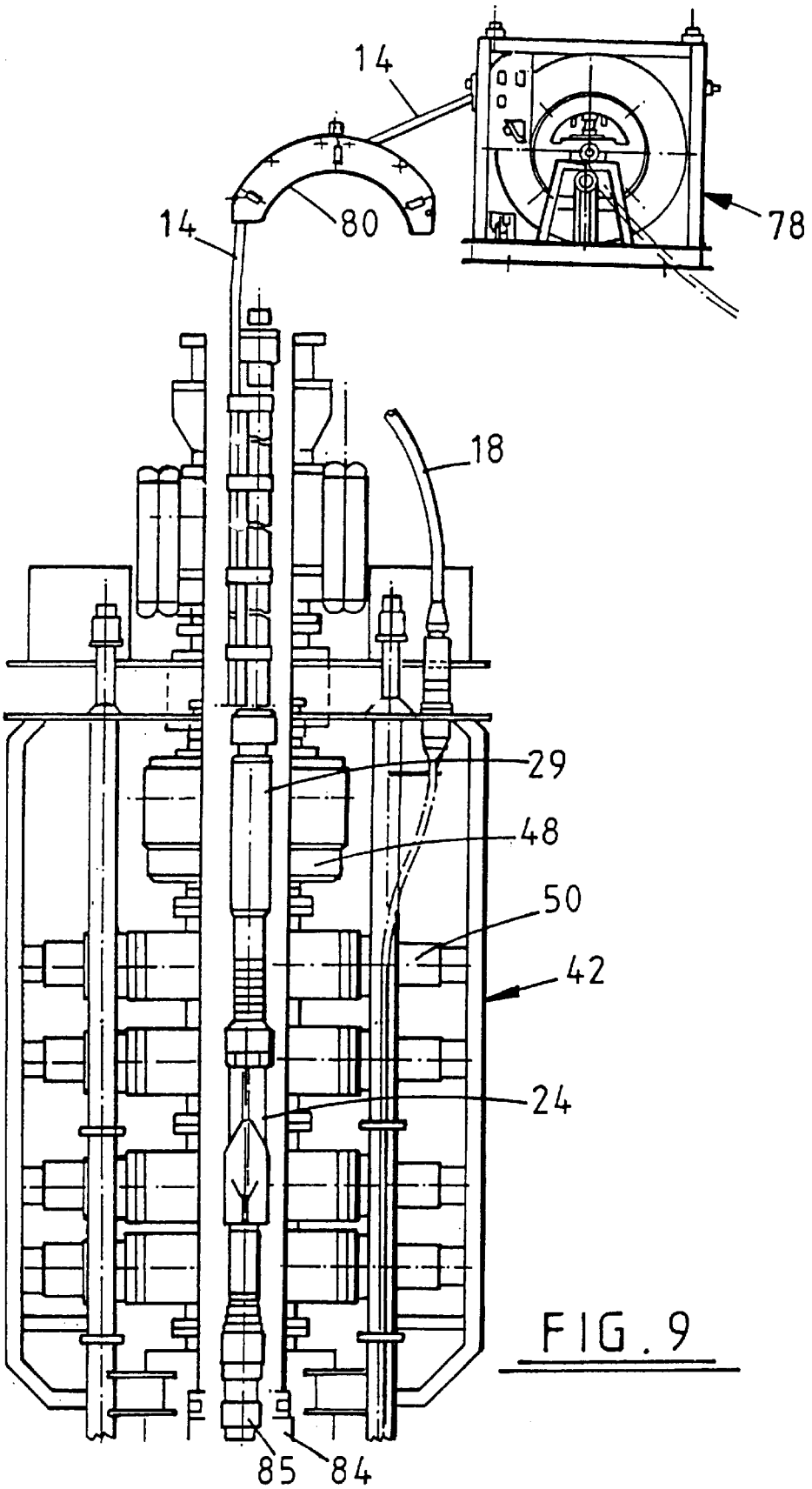
Figure 10:
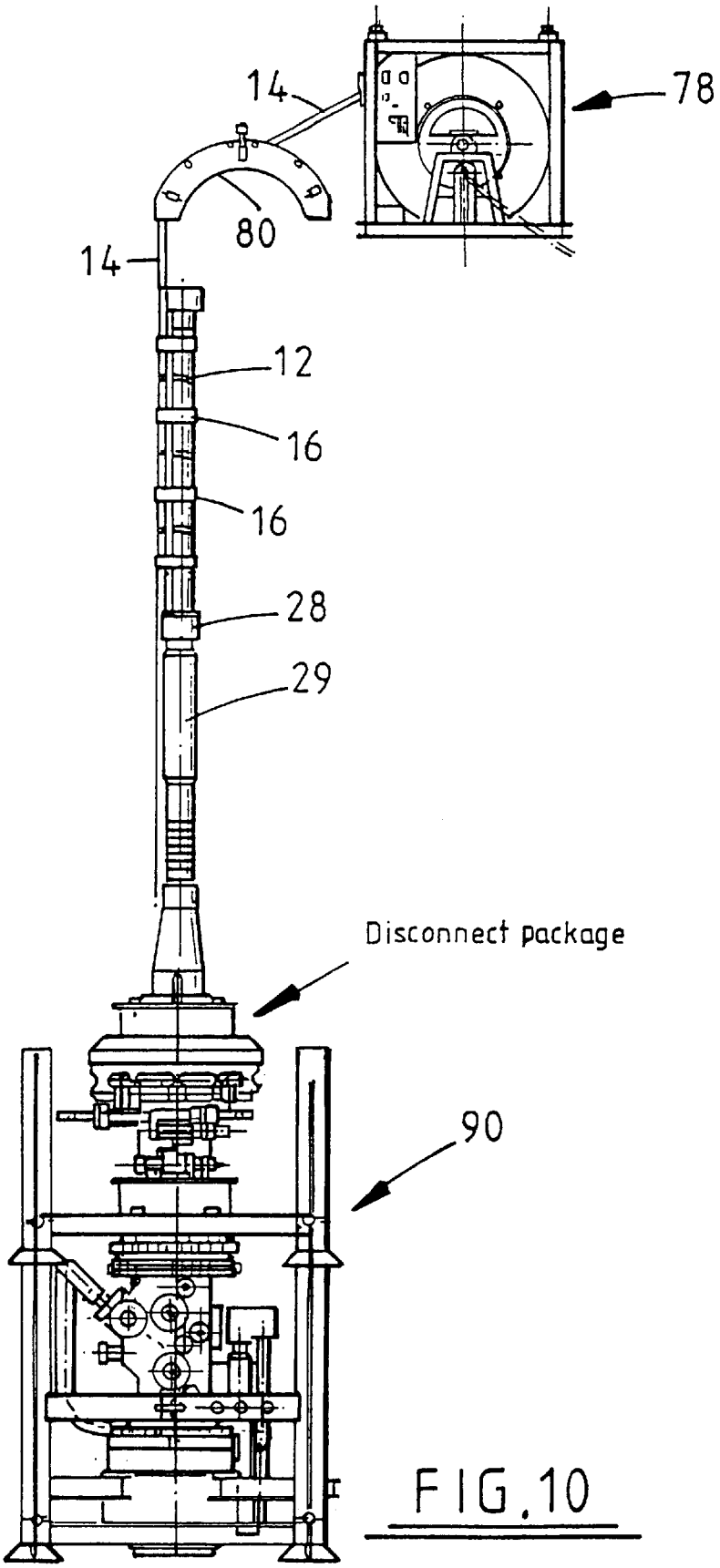

FIG. 3*a* is an enlarged sectional view of top of a landing spool, a landing spool adaptor and depicting how the tubing riser and coiled tubing are coupled to the landing spool adaptor;

FIG. 3*b* is a cross-section view through the landing spool showing the relative positions of the main production bore and the annulus bore;

FIG. 4 is a longitudinal sectional view through a BOP stack with an intervention tool coupled to an improved dual bore riser in accordance with an embodiment of the present invention with the riser coupled via a 5"×2" sub-sea test tree to a proprietary tubing hanger running tool and tubing hanger;

FIG. 5 is a diagram similar to FIG. 4 but showing 5"×2" completion sub-sea test tree coupled to an Expro test tubing hanger and production casing hanger;

FIG. 6 depicts the surface arrangement of the riser and coiled tubing for permitting wireline access;

FIG. 7 depicts a conventional coiled tubing reel and a sheave with straightening rolls for receiving coiled tubing from the reel and straightening the tubing for coupling to the tubing riser shown in FIG. 6 and FIG. 3;

FIG. 8 is a schematic representation of an assembled landing string including an improved dual bore riser in accordance with an embodiment of the present invention used in deploying a 5"×2" tubing hanger running tool;

FIG. 9 is a diagrammatic view of a BOP stack with a tubing hanger run and landed in a wellhead using an improved dual bore riser in accordance with the present invention, and FIG. 10 shows an improved dual bore riser in accordance with the present invention used in deploying a sub-sea Christmas tree.

Figure 2:
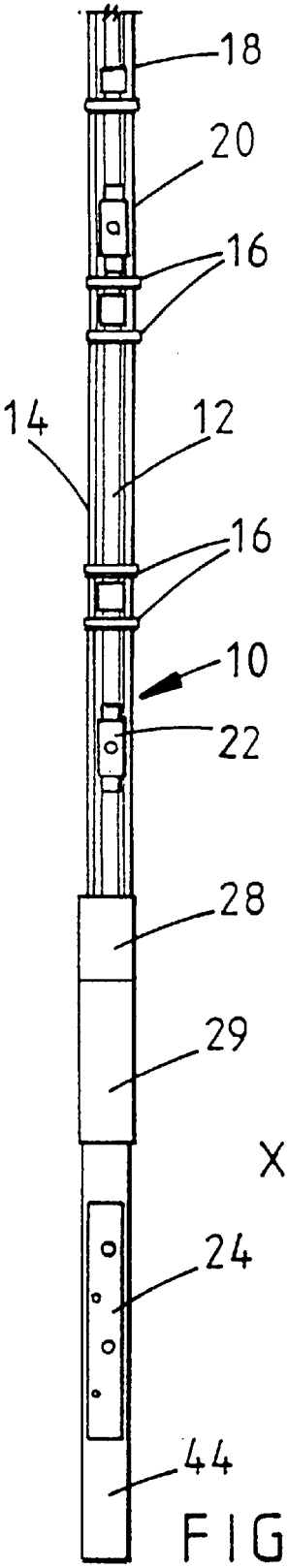
FIG. 2 is a longitudinal assembled view of a tubing landing string layout assembled in accordance with a method of the present invention.

Reference is first made to FIG. 2 of the drawings which depicts the layout of a tubing landing string 10 in accordance with an embodiment of the present invention. The string 10 mainly consists of a 5½" premium tubing riser 12 and a coiled tubing annulus riser 14 which is coupled to the tubing riser 12 at various spaced locations along the length of the riser 10 by restraining clamps 16. An umbilical 18 is also coupled to the riser 10 via the clamps 16. In the layout shown the riser contains a lubricator valve 20 at its upper end and retainer valve 22 at an intermediate position and a dual bore sub-sea test tree 24 is located at its lower position. The sub-sea test tree 24 has two ball valves in the main bore and two separate ball valves in the annulus bore. The completion test tree 24 is coupled to dual bore tubing hanger running tool 44.

The tubing riser 12 and coiled tubing 14 are coupled to the dual bore completion tree 24 via the landing spool adaptor 28 best shown in FIG. 2 and FIG. 3*a*. The 5½" tubing riser is received by the landing spool adaptor 28 in a threaded bore 30. The coiled tubing 14 is received in a coil tubing terminator 32 using a conventional coiled tubing swage and connector system. The landing spool adaptor 28 may receive different sizes of coil tubing and tubing riser although in the drawings shown the tubing riser is a 5½ and the coil tubing is 2⅞". The landing spool adaptor is coupled to the landing spool 29 via a connector 36 and it will be seen that the bore 13 of the tubing riser 12 registers with the internal bore 38 of the landing spool 29. Similarly, the internal bore 15 of the coiled tubing registers with the annulus bore 40 of the landing spool to provide communication in the main bore and in the annulus bores.

Sectional view FIG. 3*b* taken on the lines X—X of FIG. 3*a* shows that the main bore 38 offset from the centre of the landing spool, as is annulus bore 40. This arrangement is termed dual bore.

Reference is now made to FIG. 4 of the drawings which is a longitudinal sectional view through a BOP stack 42 which contains a tubing landing string layout similar to that shown in FIG. 3*a* disposed in the bore of the BOP stack 42. In this case, the riser is coupled to a 5"×2" sub-sea test tree 24 which, in turn, is coupled to a proprietary tubing hanger running tool 44 such as Cooper or FMC tool and to a proprietary completion tubing hanger 16. It will be seen that the landing string layout is spaced out such that the annular BOP 48 can be closed around the exterior of the landing spool 29 to provide an additional annulus barrier if required. It will be seen that in this case, the space out is such that the completion tree 24 is disposed beneath the blind/shear rams 50 as disclosed in applicant's copending published PCT application WO93/03255.

Figure 1:
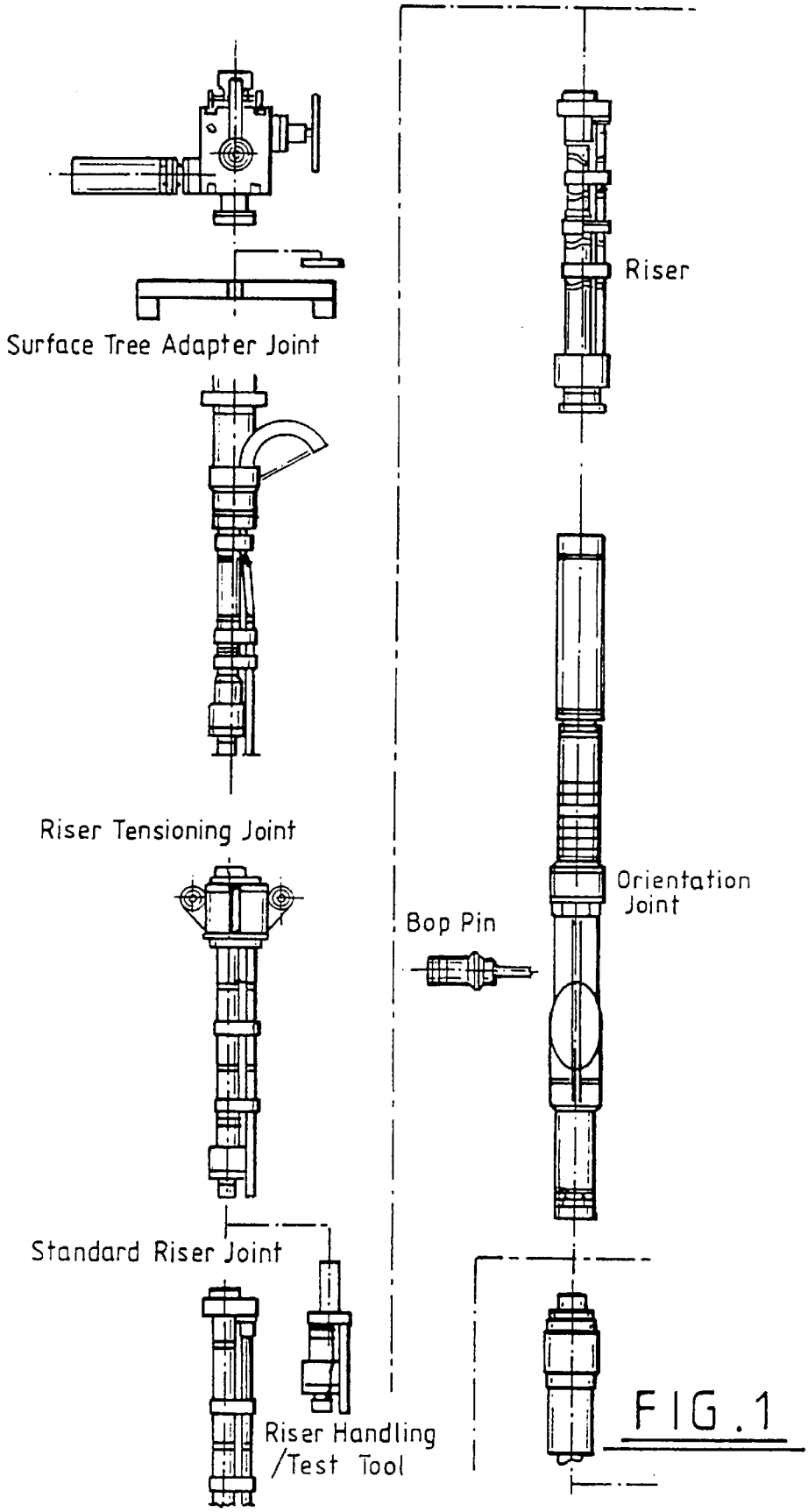
FIG. 1 is an exploded view of a dual bore riser of a type typically found in prior art systems.

It will be appreciated that the function of the tubing riser 10 is substantially identical to that of the 5" section of a standard riser of the type shown in FIG. 1 as far as pressure integrity for the well fluid flow and structural capability to run and retrieve the completion test string is required.

Reference is now made to FIG. 5 of the drawings which is similar to FIG. 4 and which shows a dual bore riser coupled via 5"×2" completion sub-sea test tree to an Expro test tubing hanger and a production casing hanger. In this case it will be appreciated that the height of the BOP stack shear rams is not critical but the annular BOP must engage the landing string 29. It will also be appreciated that like numerals in this figure refer to the same parts as in FIG. 4.

It will be appreciated that the coil tubing riser is coupled to the 5½" tubing riser approximately every 30 ft. which is the length of a tubing riser section. Conveniently, at the same time, the umbilical is also coupled to the 5½" tubing riser.

Reference is now made to FIG. 6 of the drawings which depicts the surface pressure control equipment for a wireline access option into a 2" line for tubing hanger plug retrieval. In this case, it will be seen that the tubing riser 12 is coupled to a 5" surface flow head 60 which, in turn, is coupled to an elevator sub 62 for a lifting frame and to a wireline stuffing box 64. The coiled tubing 14 is coupled to a frame 66 via a swage connection 68. The function of the frame 66 is to allow the coil tubing to be pretensioned by exerting a hydraulic force on the dual pistons (65) which is subsequently transferred to the tubing. The hydraulic pressure is regulated by the use of a gas/liquid accumulator allowing the pistons to expand and retract and therefore compensate for the subsequent change in length of the dual risers. The coiled tubing connection 68 is coupled via a 2" master valve 70 to a T-connection 72 which is has an annular inlet 74 on one leg so that annulus fluids can be pumped through the coiled tubing and the other leg is coupled to a blind cap 76 which can be removed to facilitate wireline entry. It will be appreciated that if no wireline operations are required, the coiled tubing can be left on the reel, thereby providing annulus communications via a conventional slip ring assembly.

FIG. 7 depicts a conventional coiled tubing reel 78 and tubing 14 is taken from the reel via a curved sheave 80 which includes straightening rollers (not shown) so that the coiled tubing 14 which leaves the sheath is substantially straight and this, in turn, is coupled to the tubing riser 12 as shown in FIGS. 3 and 6 by clamp 16 at various locations along its length after first having been coupled to the landing spool adaptor.

In operation, the riser is run by firstly coupling the desired arrangement of intervention tools, such as tubing hanger, running tool and completion test tree together. Next the landing spool 29 is coupled to the completion sub-sea test tree 24 and the landing spool adaptor 29 is coupled to the landing spool 29. These are held at the surface by conventional tongs and then the first section of the 5½" tubing riser is coupled to the landing spool via bore 30. Similarly, the leading end of the coiled tubing 14 is coupled to the connector 32 by the swage and quick connector system. Thus, the first part of the riser 10 is formed. The intervention assembly and the riser is then lowered and at the next section the coiled tubing is clamped to the tubing riser and also to the umbilical and this is repeated until the riser is of the desired length such that the correct space out is achieved with the landing spool 29 being disposed in the annular BOP 48 and the 5"×2" completion tree 24 is disposed in the BOP stack 42 such that it is beneath the shear/blind rams 50.

In this position the equipment can be operated as required from surface to provide appropriate batch completion and clean ups prior to the installation of a sub-sea production tree.

It will be appreciated that a conventional tubing hanger and tubing hanger running tool is only required if the well is suspended with the completion in place and the elimination of the items from the system not required would provide substantial savings in both operational leadtime and cost. These items could be replaced by a temporary test hanger assembly which would be run on the lower section valve on the 5"×2" completion test tree and which would allow the tree to lock into the wellhead and obtain an annulus seal via an elastomeric pack off in the casing hanger or an adaptor bowl within the wellhead.

It will also be appreciated that various modifications may be made to the method and apparatus hereinbefore described without departing from the scope of the invention. For example, it will be appreciated that the improved dual bore riser may be used to deploy tubing hanger, a completion, a sub-sea test tree and a sub-sea Christmas tree. These alternatives are shown in FIGS. 8, 9 and 10 of the drawings in which like numerals refer to like parts.

In FIG. 8 it will be seen that the 5"×2" test tree 24 has an orientation helical cam profile 82 for mating with a BOP pin for correctly orienting tubing hanger running tool 44. In this case, a completion is run on 5½" tubing using rig-mounted elevators and coiled tubing from the reel.

FIG. 9 shows a tubing hanger run 85 and landed in the sub-sea wellhead 84 which is located at the bottom of BOP stack 42 and similarly FIG. 10 shows a landing string using 5½" tubing and coiled tubing coupled to a sub-sea conventional Christmas tree 90.

It will be appreciated that the improved dual bore riser in accordance with the present invention provides significant benefit over the existing dual bore risers. Firstly it is substantially less expensive, costing between 10%–20% of the existing system, and uses approximately only 15% of the storage space of conventional dual bore risers which is a considerable advantage in off-shore vessels where storage space is usually very limited. The improved dual bore riser does not require specialised equipment such as spiders and the like which minimises cost and reduces running time because the equipment required for the deployment of the riser is identical to that used to deploy the completion. In addition, the new system offers a considerable reduction in the number of potential leak paths in the annulus system, i.e. from one every 40" because of previous couplings, to one at each termination. In addition, in conventional risers elastomeric seals are used in the monobore riser and this has been replaced by metal-to-metal connections in the 5½" tubing riser further improving the reliability of the system. The use of coiled tubing termination eliminates compressive coupling normally associated with the proprietary dual bore riser system and this also minimises the bending imparted to the 5.5" tensile structural member.

The improved dual bore riser in accordance with the present invention has a number of additional advantages. Firstly, it provides additional isolation barriers by incorporating two valves in the 5"×2" completion sub-sea test tree and the well may be left suspended which provides a subsequent reduction in rig time and formation damage and reduces the role of the BOP to a secondary barrier by avoiding the requirement for the BOP stack to provide annulus isolation.

We claim:

1. A method of running intervention equipment into a well during or after completion, said method comprising:

providing well equipment for running into a well, coupling sequential sections of tubing riser to the well equipment, providing a coiled tubing riser of smaller diameter than the tubing riser, coupling the coiled tubing riser to said well equipment and feeding the coiled tubing riser with the tubing riser into a well such that the tubing riser is adjacent and parallel to the coiled tubing, coupling the coiled tubing riser to the tubing riser at a plurality of spaced locations along the length of the riser to create a dual bore riser, and raising or lowering the dual bore riser with the well equipment as required for well operations.

2. A method as claimed in claim 1 including the further step of restraining the coiled tubing to the tubing riser at a joint formed by each adjoining pair of said sequential sections along the length of the tubing riser.

3. A method as claimed in claim 1 including the further step of providing the well equipment with a 5"×2" completion sub-sea tree which has a mainbore and a parallel annulus bore, the main bore having at least one operable valve and the annulus bore having at least one operable valve.

4. A method as claimed in claim 1 comprising the further step of cutting the coiled tubing riser at the surface and coupling the cut tubing to a frame and valve assembly which is clamped to a conventional surface tree.

5. A method as claimed in claim 1 to provide wireline access including the further step of pretensioning the coiled tubing riser thereby avoiding the requirement for an accurate termination of the coiled tubing and compensating for any changes in overall length between the two riser strings.

6. A method as claimed in claim 1 including the further step of providing annulus communication through the tubing riser on a reel via a conventional slip ring assembly when no wireline operation is required and the coiled tubing riser is left on the reel.

7. An improved dual bore riser for coupling to intervention well equipment prior to installation in a sub-sea production tree, said improved dual bore riser comprising:

a first tubular riser element of a first bore diameter, a second coiled tubing annulus riser element, said first and second riser elements being adapted to be connected to a well intervention tool, said first and second riser elements being coupled together at a plurality of spaced locations along the length of the dual bore riser.

8. A riser as claimed in claim 7 wherein the second coiled tubing riser is coupled to the first tubing riser at every riser joint along the length thereof.

9. A riser as claimed in claim 7 wherein the well tool run is a 5"×2" completion sub-sea test tree.

10. A riser as claimed in claim 7 wherein the coiled tubing is coupled to a landing spool disposed between the riser and the completion test tree.

11. A riser claimed in claim 7 wherein the coiled tubing is coupled to the landing spool via a swage and quick connector system and the tubing riser is coupled to the landing spool via a landing spool adaptor.

12. A method of forming a dual bore riser for running well intervention equipment, said method comprising the steps of:

providing a plurality of first tubular riser sections of a first diameter;

providing a second coiled tubing annulus riser stored on a reel;

coupling said first tubular riser sections together to form a first tubular riser;

unreeling said coiling tubing annulus riser from the reel; and coupling the unreeled coiled tubing riser to the first tubular riser at spaced locations along the length thereof to create a dual bore riser.

* * * * *